US007083260B2

(12) United States Patent
Song

(10) Patent No.: US 7,083,260 B2
(45) Date of Patent: Aug. 1, 2006

(54) PRINTER HEAD USING A RADIO FREQUENCY MICRO-ELECTROMECHANICAL SYSTEM (RF MEMS) SPRAYER

(75) Inventor: In-sang Song, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 73 days.

(21) Appl. No.: 10/686,770

(22) Filed: Oct. 17, 2003

(65) Prior Publication Data

US 2004/0227787 A1 Nov. 18, 2004

(30) Foreign Application Priority Data

Oct. 17, 2002 (KR) ..... 10-2002-0063573

(51) Int. Cl.
*B41J 2/135* (2006.01)
*B41J 2/05* (2006.01)

(52) U.S. Cl. ..... 347/44; 347/46; 347/67

(58) Field of Classification Search ..... 347/46, 347/54, 68–73, 67, 44
See application file for complete search history.

(56) References Cited

U.S. PATENT DOCUMENTS 4,323,908 A * 4/1982 Lee et al. ..... 347/27
5,825,386 A * 10/1998 Ohashi ..... 347/71
6,273,551 B1 8/2001 Guerin et al.
6,416,172 B1 * 7/2002 Jeong et al. ..... 347/72
6,422,685 B1 * 7/2002 Kondo et al. ..... 347/46

FOREIGN PATENT DOCUMENTS

EP 0 421 718 A1 4/1991
WO WO 01/62394 A2 8/2001

OTHER PUBLICATIONS

Fukumoto et al, "Printing with Ink Mist . . . ",J. Imaging Science & Technology, 44(5):398-405 (Sep. 2000).

* cited by examiner

*Primary Examiner*—Manish Shah
*Assistant Examiner*—Geoffrey S. Mruk
(74) *Attorney, Agent, or Firm*—Lee & Morse, P.C.

(57) ABSTRACT

A printer head using a radio frequency micro-electromechanical system (RF MEMS) sprayer includes an inner pressure chamber having a liquid inlet and a liquid outlet; a cavity resonator surrounding the inner pressure chamber, wherein the cavity resonator inputs a predetermined cavity resonance frequency signal to increase an inner pressure of the inner pressure chamber; a signal transmitting unit for generating the predetermined cavity resonance frequency signal and for inputting the generated cavity resonance frequency signal into the inner pressure chamber through the cavity resonator in response to an external input control signal; and a liquid chamber for supplying a liquid, wherein the liquid inlet and the liquid outlet each extend through the inner pressure chamber and the cavity resonator so that when an inner pressure of the inner pressure chamber is increased by the cavity resonator, a liquid from within the inner pressure chamber is ejected.

20 Claims, 3 Drawing Sheets

PRINTER HEAD USING A RADIO FREQUENCY MICRO-ELECTROMECHANICAL SYSTEM (RF MEMS) SPRAYER

BACKGROUND OF THE INVENTION

1. Field of the Invention

The present invention relates to an inkjet printer head. More particularly, the present invention relates to a printer head using a radio frequency micro-electromechanical system (RF MEMS) sprayer including an RF cavity resonator.

2. Background of the Related Art

In general, a spraying device for spraying a droplet of a liquid may be used in an inkjet printer head, a MEMS cooling device, or the like. A driving method for an inkjet printer head may be classified into a mechanical driving method using a piezoelectric element or a thermal driving method.

FIG. 1 illustrates a cross-sectional view of a conventional printer head using a piezoelectric element.

As shown in FIG. 1, a conventional printer head using a piezoelectric element includes a plate-shaped piezoelectric body 7, a vibrating plate 6 disposed under the piezoelectric body 7 for converting a longitudinally expanding motion of the piezoelectric body 7 into a bending motion, a liquid chamber layer 1 disposed under the vibrating plate 6 and including a liquid chamber 2 for storing ink, and a nozzle plate 5 having a nozzle 5*a* for spraying a droplet of ink and covering the liquid chamber layer 1. The nozzle plate 5 has may have a plurality of nozzles 5*a* each spaced at a predetermined distance interval.

The liquid chamber layer 1 is formed of a plurality of metal layers welded with pressure. The liquid chamber 2 for storing ink and a restrictor 3 for controlling a flow of ink are provided in the liquid chamber layer 1. The nozzle plate 5 having the plurality of nozzles 5*a* is positioned under the liquid chamber layer 1. The vibrating plate 6 is provided to cover a pressure chamber 4 above the liquid chamber layer 1. The restrictor 3 provides flow communication between the liquid chamber 2 and the pressure chamber 4. The nozzles 5*a* are connected to the pressure chamber 4. An electrode (not shown) for operating the piezoelectric body 7 is disposed above the vibrating plate 6.

When the piezoelectric body 7 is polled (i.e., generating an orientation in a piezoelectric body by applying an electric field to the piezoelectric body) to expand longitudinally, the vibrating plate 6 is bent and an inner pressure of the pressure chamber 4 increases to spray a droplet of ink outwardly through the nozzles 5*a*. While the droplet of ink is sprayed, the restrictor 3 blocks ink remaining in the pressure chamber 4 from flowing back into the liquid chamber 2. When the shape and position of the vibrating plate 6 are restored, the pressure chamber 4 is replenished with ink from the liquid chamber 2 through the restrictor 3.

To manufacture the vibrating plate 6, a green sheet is made of $ZrO_2$. Then, holes of a predetermined size are bored into predetermined positions of the sheet. Subsequently, the sheet is heated to a high temperature, e.g., at least about 1,000° C. In addition, a lower electrode of an identical size is formed on the thin $ZrO_2$ plate.

To manufacture the piezoelectric body 7, the $ZrO_2$ plate with the lower electrode being formed thereon is screen-printed by precisely arraying a piezoelectric body paste. The piezoelectric body paste, having been screen-painted onto the $ZrO_2$ plate, is then heated at a high temperature to form an upper electrode on the piezoelectric body 7.

A conventional inkjet printer head using the above-described piezoelectric body has a disadvantage of a low printing speed due to an operating speed limit of the piezoelectric body. In addition, such a conventional inkjet printer head has difficulty in controlling an amount of ink discharged. Further, the manufacturing process is complex and the structure is overly complicated thereby rendering high integration difficult.

In the alternate driving method of an inkjet printer head, i.e., the thermal driving method, heat is applied to a thin pipe so that an air bubble is generated to increase an inner pressure of the pipe. This increase in inner pressure causes the discharge of a liquid.

More specifically, a passage for ink is formed inside a semiconductor and a thermal resistor is disposed around the passage. Then, a current is applied to the resistor to cause the resistor to be heated and to generate an air bubble in the passage. The generated air bubble increases the inner pressure of the pipe thereby discharging ink from the pipe.

Output quality of an output device using an inkjet printer head varies severely according to ink quality and an amount of discharged ink. In printing a color image, if an amount of ink discharged is too great, then the printed image becomes dark overall, thereby lowering a resolution of the printed image.

Alternately, if an amount of ink discharged is too small, an output image becomes unclear or a quality of the image is degraded since some of the nozzles do not discharge any ink. Thus, a thermal driving inkjet printer head attempts to discharge ink adequately by regulating a voltage applied to the thermal resistor or a time for the heating.

The thermal driving inkjet printer head, however, is severely affected by ambient temperature and humidity conditions. Under high temperature and humidity conditions, such a printer head has problems in that an output image is too dark. Under low temperature and humidity conditions, ink is not discharged or an output image becomes unclear. Further, such a printer head has problems in that it is not easy to precisely regulate an amount of ink discharged and a discharging reaction rate of ink is low due to a limited operating reaction rate of the thermal resistor. Moreover, the printer head has additional problems in that the structure thereof is so complicated that it is not easy to highly integrate a plurality of nozzles, thereby further limiting the resolution of an output image.

SUMMARY OF THE INVENTION

It is a feature of an embodiment of the present invention to attempt to solve at least some of the above problems and/or disadvantages and to provide a printer head using an RF MEMS sprayer that is capable of a fast discharging reaction rate of ink, an easy and precise regulation of discharging ink and a simple structure to permit high integration of nozzles.

The foregoing and other features and advantages may be realized by providing a MEMS sprayer including an inner pressure chamber having a liquid inlet and a liquid outlet; a cavity resonator surrounding the inner pressure chamber, wherein the cavity resonator provides a predetermined cavity resonance frequency signal to increase an inner pressure of the inner pressure chamber; a signal transmitting unit for generating the predetermined cavity resonance frequency signal and for inputting the generated cavity resonance frequency signal into the inner pressure chamber through the cavity resonator in response to an external input control signal; and a liquid chamber for supplying a liquid to the inner pressure chamber, the liquid chamber being in flow communication with the inner pressure chamber through the liquid inlet, wherein the liquid inlet and the liquid outlet each extend through the inner pressure chamber and the cavity resonator so that when an inner pressure of the inner pressure chamber is increased by the cavity resonator, a liquid from within the inner pressure chamber is ejected outwardly through the liquid outlet.

Preferably, the cavity resonator is formed of a metal having a hermetically sealed structure.

Preferably, the RF MEMS sprayer may further include a substrate having a nozzle disposed in a position corresponding to the liquid outlet, the substrate being welded to a lower side of the cavity resonator where the liquid outlets are formed.

The cavity resonator may include a coupling slot formed on a lower side of the cavity resonator, which is in contact with the substrate, the coupling slot receiving the cavity resonance frequency signal from the cavity resonator. The signal transmitting unit may be disposed at a position corresponding to the coupling slot with the substrate being disposed therebetween.

The signal transmitting unit may include a signal generator for generating the cavity resonance frequency signal; and a signal input terminal disposed at a position corresponding to the coupling slot for inputting the cavity resonance signal to the cavity resonator through the coupling slot. The signal transmitting unit may further include a signal amplifier for amplifying the cavity resonance frequency signal from the signal generator.

The signal transmitting unit may be disposed at a position on the substrate corresponding to the liquid outlet, the substrate being disposed therebetween, the signal transmitting unit inputs the cavity resonance signal into the cavity resonator through the liquid outlet, wherein the nozzle extends to a position corresponding to the liquid outlet.

In the RF MEMS sprayer, the liquid inlet prevents a liquid inside the inner pressure chamber from flowing back into the liquid chamber when an inner pressure of the inner pressure chamber is increased by the cavity resonator.

In an embodiment of the present invention, the substrate may further include a plurality of nozzles, each nozzle corresponding to a position of one of a plurality of liquid outlets. Similarly, the inner pressure chamber surrounded by the cavity resonator may be a plurality of inner pressure chambers, each being surrounded by a respective one of a plurality of cavity resonators, and wherein each of the plurality of inner pressure chambers is disposed at a predetermined distance interval from an adjacent one of the plurality of inner pressure chambers.

BRIEF DESCRIPTION OF THE DRAWINGS

The above and other features and advantages of the present invention will become more apparent to those of ordinary skill in the art by describing in detail preferred embodiments thereof with reference to the attached drawings in which.

DETAILED DESCRIPTION OF THE INVENTION

Figure 1:
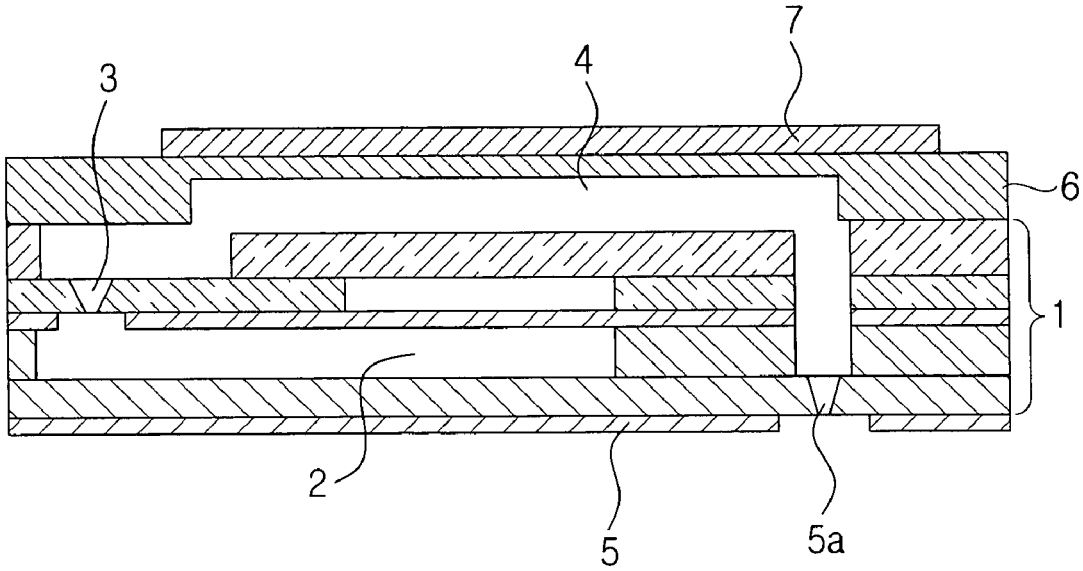
FIG. 1 (PRIOR ART)
FIG. 1 illustrates a cross-sectional view of a conventional printer head using a piezoelectric element.

Korean Patent Application No. 2002-63573, filed on Oct. 17, 2002, and entitled: "Printer Head Using RF MEMS Sprayer," is incorporated by reference herein in its entirety.

The present invention will now be described more fully hereinafter with reference to the accompanying drawings, in which preferred embodiments of the invention are shown. The invention may, however, be embodied in different forms and should not be construed as limited to the embodiments set forth herein. Rather, these embodiments are provided so that this disclosure will be thorough and complete, and will fully convey the scope of the invention to those skilled in the art. In the drawings, the thickness of layers and regions are exaggerated for clarity. It will also be understood that when a layer is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like numbers refer to like elements throughout.

Figure 2A:
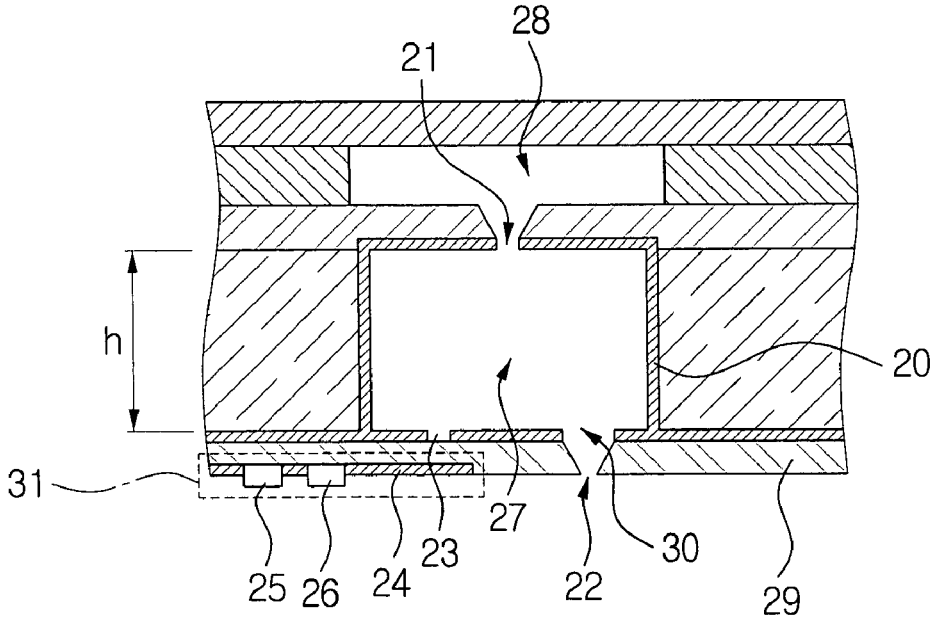
FIG. 2A illustrates a cross-sectional view of a printer head using an RF MEMS sprayer in accordance with a first embodiment of the present invention.
Figure 2B:
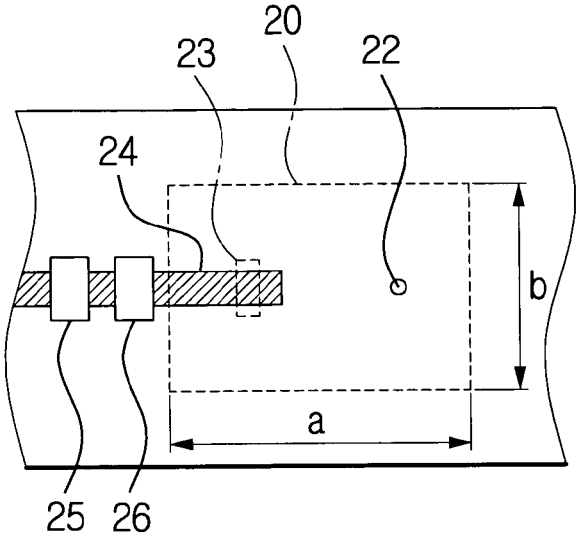
FIG. 2B illustrates a bottom view of the printer head in FIG. 2A.

FIG. 2A illustrates a cross-sectional view of a printer head using an RF MEMS sprayer in accordance with a first embodiment of the present invention. FIG. 2B illustrates a bottom view of the printer head in FIG. 2A.

As shown in FIGS. 2A and 2B, an RF MEMS sprayer includes an inner pressure chamber 27 disposed inside thereof, a liquid inlet 21 disposed at an upper side of the inner pressure chamber 27, and a cavity resonator 20 having a coupling slot 23 for receiving a cavity resonance frequency signal, and a liquid outlet 30 disposed at a lower side of the inner pressure chamber.

The MEMS sprayer 20 further includes a substrate 29 having a nozzle 22 at a position corresponding to the liquid outlet 30. The substrate 29 is welded to the lower side of the cavity resonator 20 and a signal transmitting unit 31 is welded under the substrate 29.

The signal transmitting unit 31 includes a signal input terminal 24 disposed at a position facing the coupling slot 23 with the substrate 29 positioned therebetween, a signal generator 25 disposed at an opposite end of the signal transmitting unit 31 from the signal input terminal 24 for generating a cavity resonance frequency signal and a signal amplifier 26 for amplifying the generated cavity resonance frequency signal.

It is well known that a cavity resonance frequency resonated by the cavity resonator 20 is a function of a cavity volume and thus a detailed description thereof will be omitted.

Regarding the process of discharging an inner material, e.g., a liquid, from the inner pressure chamber 27 surrounded by the cavity resonator 20, the process is as follows.

The cavity resonator 20 is made of metal having a hermetically sealed structure, a cavity resonance frequency input thereinto causes the resonator 20 to resonate, which causes the inner material to expand, thereby increasing an inner pressure of the cavity resonator 20 and the inner pressure chamber 27. As a result, the inner material is sprayed outwardly through a small outlet, e.g., a liquid outlet 30.

When a cavity volume of the resonator 20 is about $2.86\times10^{-14}$ $mm^3$, and a corresponding cavity resonance frequency signal is input to the cavity resonator 20, it is preferable to have input energy ranging from about 3.9 to 8.0 μJ. Output energy, which is an energy with which the inner material of the inner pressure chamber 27 and the cavity resonator 20 is outwardly discharged, is about $5\times10^{-17}$ J. In FIGS. 2A, 2B, 3A, and 3B, the dimensions of the inner pressure cavity chamber 27 are represented by reference characters a and b for width and length, respectively. Reference character h indicates a height of an inner wall of the inner pressure cavity chamber 27.

The cavity resonator 20 and the inner pressure chamber include a liquid inlet 21, which provides flow communication from a liquid chamber 28 into the cavity resonator 20 and the inner pressure chamber 27, at an upper side of the cavity resonator 20. The liquid inlet 21 prevents a liquid remaining in the inner pressure chamber 27 and the cavity resonator 20 from flowing back through the liquid inlet and into the liquid chamber 28 when an inner pressure of the inner pressure chamber 27 is increased. The cavity resonator 20 further includes the liquid outlet 30 at a lower side thereof.

When the cavity resonator 20 provides a cavity resonance frequency signal to resonate, the inner pressure of the inner pressure chamber 27 is increased and thus the liquid inside the inner pressure chamber 27 is discharged outwardly through the liquid outlet 30. The liquid outlet 30 extends through the inner pressure chamber 27, the cavity resonator 20, and the substrate 29, which may be welded to a lower side of the cavity resonator 20.

The substrate 29 includes the nozzle 22 at a position corresponding to the liquid outlet 30, so that liquid inside the inner pressure chamber 27 is discharged in a droplet outwardly through the nozzle 22. The substrate 29 is provided below the inner pressure chamber 27, with the signal generator 25, signal amplifier 26 and signal transmitting unit 31 having the signal input terminal 24 provided on the substrate 29.

The signal generator 25 generates a cavity resonance frequency signal, for the cavity resonator 20 to resonate, in response to an external input control signal (not shown) and outputs the cavity resonance frequency signal to the signal amplifier 26. The signal amplifier 26 inputs the cavity resonance frequency signal from the signal generator 25 in response to the external input control signal and amplifies the input signal to transmit the amplified signal to the signal input terminal 24. The signal input terminal 24 is disposed at a position facing the coupling slot 23 at the lower side of the substrate 29.

In operation, liquid flowed in through the liquid inlet 21 increases the volume to raise an inner pressure of the inner pressure chamber 27 so that the in-flowed liquid is sprayed in drops outwardly through the liquid outlet 30 and the nozzle 22.

When a signal input is stopped to the cavity resonator 20, a volume of liquid remaining inside the inner pressure chamber 27 decreases, and an inner pressure of the inner pressure chamber 27 is consequently lowered so that liquid flows into the inner pressure chamber 27 from the liquid chamber 28 through the liquid inlet 21.

The printer head using the RF MEMS sprayer according to an embodiment of the present invention may include a plurality of RF MEMS sprayers each having the above-described structure. When a plurality of sprayers are provided, each may be positioned at a predetermined distance interval from an adjacent sprayer. Similarly, a liquid chamber 28, as illustrated in the attached figures, may be disposed at an upper portion of cavity resonators 20 for providing ink to the inner pressure chamber 27 through liquid inlets 21.

In operation, a signal input unit 31 corresponding to the cavity resonator 20 generates a cavity resonance frequency signal in response to an external input control signal and inputs the generated signal into the cavity resonator 20, thereby resonating the cavity resonator 20. As a result of this resonance, the inner pressure of the inner pressure chamber 27 increases and, since liquid inside the inner pressure chamber 27 is not able to flow backward through the liquid inlets 21, a droplet of liquid from inside the inner pressure chamber 27 is sprayed outwardly through the liquid outlet 30 and the nozzle 22.

Preferably, an amplification factor of the signal amplifier 26 and an input time of a cavity resonance frequency signal to the cavity resonator 20 may be finely adjusted to facilitate control of the inner pressure of the inner pressure chamber 27 and precise regulation of an amount of discharged ink.

Figure 3A:
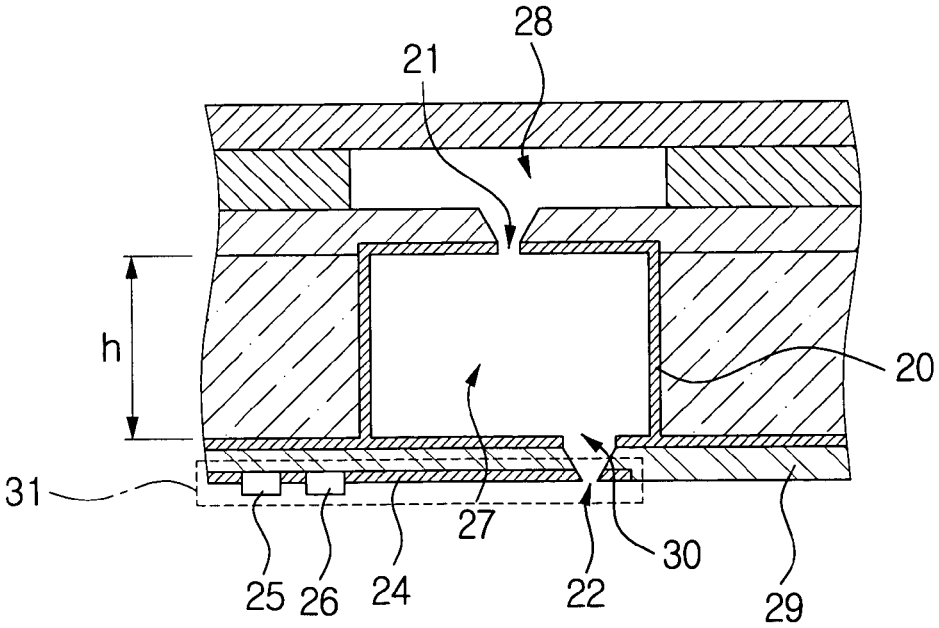
FIG. 3A illustrates a cross-sectional view of a printer head using an RF MEMS sprayer in accordance with a second embodiment of the present invention.
Figure 3B:
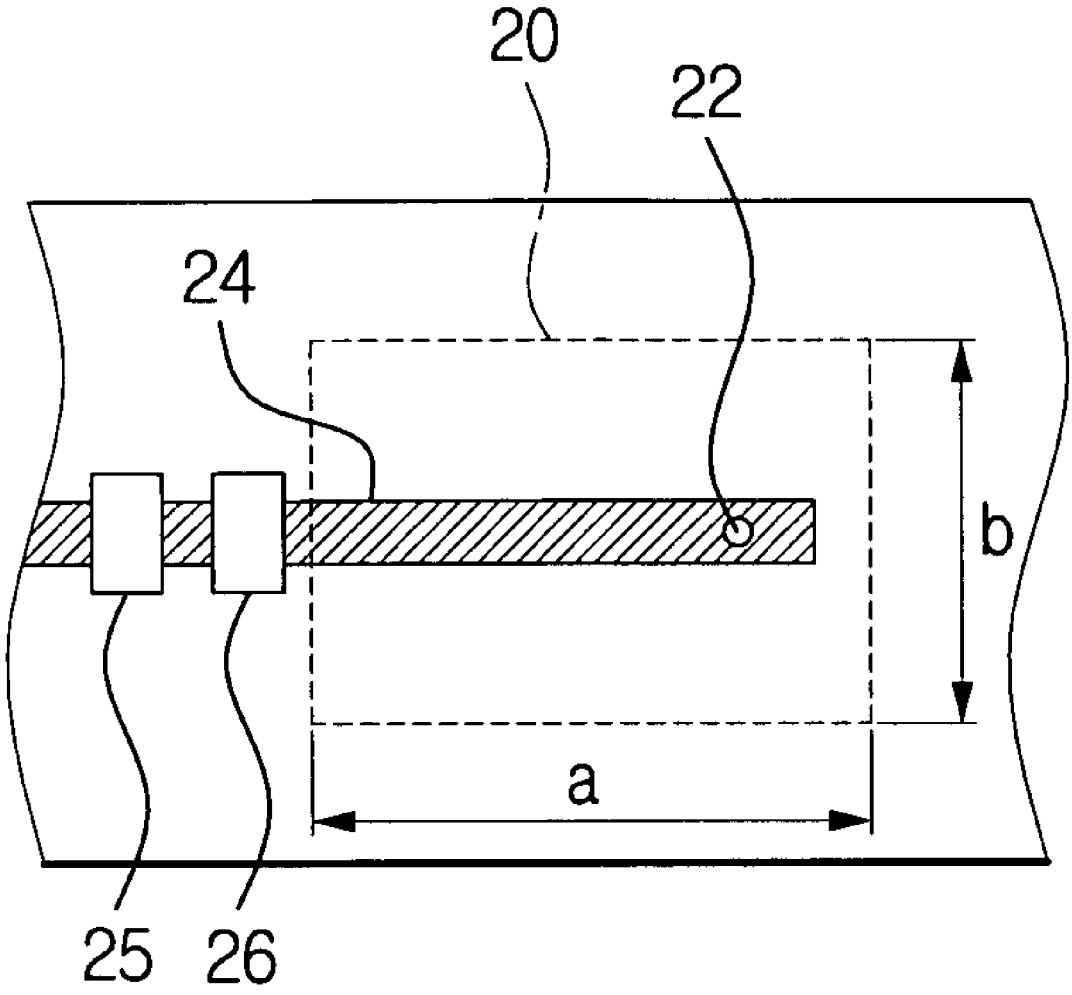
FIG. 3B illustrates a bottom view of the printer head in FIG. 3A.

With reference to FIGS. 3A and 3B, a printer head using an RF MEMS sprayer in accordance with a second embodiment of the present invention will now be described.

FIG. 3A illustrates a cross-sectional view of the printer head using the RF MEMS sprayer according to a second embodiment of the present invention. FIG. 3B illustrates a bottom view of the printer head in FIG. 3A.

As shown, the printer head according to the second embodiment has a similar structure as the printer head according to the first embodiment except that the coupling slot 23 is omitted from the second embodiment and a signal input terminal 24 is extended to a nozzle 22.

In operation, a cavity resonance frequency signal from a signal amplifier 26 is inputted to a cavity resonator 20 through a liquid outlet 30. In all other respects, the printer head using the RF MEMS sprayer having the structure of the second embodiment operates the same as the printer head according to the first embodiment.

More specifically, a cavity resonance frequency signal generated from a signal generator 25 is amplified by the signal amplifier 26 and then inputted to the cavity resonator 20 through the liquid outlet 30 to resonate the cavity resonator 20. An inner pressure of an inner pressure chamber 27 is then raised and thus a droplet of liquid from inside the inner pressure chamber 27 is sprayed outwardly through a liquid outlet 30 and nozzle 22 since the liquid inside the inner pressure chamber 27 is not able to flow back through the liquid inlet 21.

With the printer head using the RF MEMS sprayer according to an embodiment of the present invention, a discharging reaction rate of ink increases and a precise regulation of the discharge of a liquid, e.g., ink, becomes less complicated so that a printer head having a simple structure that permits a high integration of the nozzles may be provided.

Preferred embodiments of the present invention have been disclosed herein and, although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. A printer head using a radio frequency micro-electro-mechanical system (RF MEMS) sprayer, comprising:

an inner pressure chamber having a liquid inlet and a liquid outlet;

a cavity resonator surrounding the inner pressure chamber, wherein the cavity resonator provides a predetermined cavity resonance frequency signal to increase an inner pressure of the inner pressure chamber;

a signal transmitting unit for generating the predetermined cavity resonance frequency signal and for inputting the generated cavity resonance frequency signal into the inner pressure chamber through the cavity resonator in response to an external input control signal, the signal transmitting unit being electrically isolated from the cavity resonator; and a liquid chamber for supplying a liquid to the inner pressure chamber, the liquid chamber being in flow communication with the inner pressure chamber through the liquid inlet, wherein the liquid inlet and the liquid outlet each extend through the inner pressure chamber and the cavity resonator so that when an inner pressure of the inner pressure chamber is increased by the cavity resonator, a liquid from within the inner pressure chamber is ejected outwardly through the liquid outlet.

2. The printer head as claimed in claim 1, further comprising a substrate having a nozzle disposed in a position corresponding to the liquid outlet, wherein the cavity resonator includes a coupling slot formed on a lower side of the cavity resonator, which is in contact with the substrate, the coupling slot coupling the cavity resonance frequency signal to the cavity resonator.

3. The printer head as claimed in claim 2, wherein the signal transmitting unit is disposed at a position corresponding to the coupling slot with the substrate being disposed therebetween.

4. The printer head as claimed in claim 3, wherein the signal transmitting unit comprises:

a signal generator for generating the cavity resonance frequency signal; and a signal input terminal disposed at a position corresponding to the coupling slot for inputting the cavity resonance signal to the cavity resonator through the coupling slot.

5. The printer head as claimed in claim 4, wherein the signal transmitting unit further comprises:

a signal amplifier for amplifying the cavity resonance frequency signal from the signal generator.

6. The printer head as claimed in claim 5, wherein an amplification factor of the signal amplifier is adjusted to control a pressure of the inner pressure chamber.

7. The printer head as claimed in claim 2, wherein the cavity resonator comprises a metal surrounding the inner pressure chamber except at the liquid inlet, the liquid outlet and the coupling slot.

8. The printer head as claimed in claim 1, further comprising a substrate having a nozzle disposed in a position corresponding to the liquid outlet, wherein the signal transmitting unit is disposed at a position on the substrate corresponding to the liquid outlet, the substrate being disposed therebetween, the signal transmitting unit inputs the cavity resonance signal into the cavity resonator through the liquid outlet, wherein the nozzle extends to a position corresponding to the liquid outlet.

9. The printer head as claimed in claim 1, wherein the cavity resonator further comprise:

a coupling slot formed on a side of the cavity resonator for receiving the cavity resonance frequency signal into the cavity resonator.

10. The printer head as claimed in claim 1, wherein the liquid inlet prevents a liquid inside the inner pressure chamber from flowing back into the liquid chamber when an inner pressure of the inner pressure chamber is increased by the cavity resonator.

11. The printer head as claimed in claim 1, further comprising a substrate having a plurality of nozzles, each nozzle corresponding to a position of one of a plurality of liquid outlets.

12. The printer head as claimed in claim 11, wherein the inner pressure chamber surrounded by the cavity resonator is a plurality of inner pressure chambers, each being surrounded by a respective one of a plurality of cavity resonators, and wherein each of the plurality of inner pressure chambers is disposed at a predetermined distance interval from an adjacent one of the plurality of inner pressure chambers.

13. The printer head as claimed in claim 1, further comprising a substrate having a nozzle disposed in a position corresponding to the liquid outlet, the substrate being attached to a lower side of the cavity resonator where the liquid outlets are formed, wherein the signal transmitting unit is attached to the substrate opposite the cavity resonator.

14. The printer head as claimed in claim 1, wherein the signal transmitting unit extends past the liquid outlet and having a hole disposed in a position corresponding to the liquid outlet.

15. The printer head as claimed in claim 14, wherein the signal transmitting unit comprises:

a signal generator for generating the cavity resonance frequency signal; and a signal input terminal disposed at a position to the hole for inputting the cavity resonance signal to the cavity resonator through the hole.

16. The printer head as claimed in claim 15, wherein the signal transmitting unit further comprises:

a signal amplifier for amplifying the cavity resonance frequency signal from the signal generator.

17. The printer head as claimed in claim 16, wherein an amplification factor of the signal amplifier is adjusted to control a pressure of the inner pressure chamber.

18. The printer head as claimed in claim 14, wherein the cavity resonator comprises a metal surrounding the inner pressure chamber except at the liquid inlet and the liquid outlet.

19. A printer head using a radio frequency micro-electro-mechanical system (RF MEMS) sprayer, comprising:

an inner pressure chamber having a liquid inlet and a liquid outlet;

a cavity resonator surrounding the inner pressure chamber, wherein the cavity resonator controls an inner pressure of the inner pressure chamber;

an antenna providing a cavity resonance frequency signal to the cavity resonator; and a liquid chamber for supplying a liquid to the inner pressure chamber, the liquid chamber being in flow communication with the inner pressure chamber through the liquid inlet, wherein the liquid inlet and the liquid outlet each extend through the inner pressure chamber and the cavity resonator so that when an inner pressure of the inner pressure chamber is increased by a cavity resonance frequency signal supplied to the cavity resonator, a liquid from within the inner pressure chamber is ejected outwardly through the liquid outlet.

20. The printer head as claimed in claim 19, wherein the cavity resonator further comprises:

a coupling slot formed on a side of the cavity resonator for receiving the cavity resonance frequency signal into the cavity resonator.

* * * * *